US008200124B2

(12) United States Patent
Nakano

(10) Patent No.: US 8,200,124 B2
(45) Date of Patent: Jun. 12, 2012

(54) BELT UNIT AND IMAGE FORMING DEVICE

(75) Inventor: Hiroshi Nakano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 324 days.

(21) Appl. No.: 12/559,063

(22) Filed: Sep. 14, 2009

(65) Prior Publication Data

US 2010/0067951 A1 Mar. 18, 2010

(30) Foreign Application Priority Data

Sep. 16, 2008 (JP) ..... 2008-236562
Sep. 26, 2008 (JP) ..... 2008-248588

(51) Int. Cl.
*G03G 15/00* (2006.01)
*G03G 15/08* (2006.01)
*G03G 15/01* (2006.01)
*G03G 15/201* (2006.01)

(52) U.S. Cl. ..... 399/165; 399/121; 399/163; 399/302; 399/303; 399/312; 399/313

(58) Field of Classification Search ..... 399/121, 399/163, 165, 302, 303, 312, 313
See application file for complete search history.

(56) References Cited

U.S. PATENT DOCUMENTS

2008/0107435 A1* 5/2008 Scherdel et al. ..... 399/66
2009/0311013 A1* 12/2009 Hara ..... 399/302

FOREIGN PATENT DOCUMENTS

| | | | |
|---|---|---|---|
| JP | 04-148746 | | 5/1992 |
| JP | 5-026314 | | 2/1993 |
| JP | 07-157129 | | 6/1995 |
| JP | 07-214831 | | 8/1995 |
| JP | 11-079457 | | 3/1999 |
| JP | 11-102126 | | 4/1999 |
| JP | 11-344906 | | 12/1999 |
| JP | 2000-130523 | | 5/2000 |
| JP | 2000-320627 | | 11/2000 |
| JP | 2002-181144 | | 6/2002 |
| JP | 2002-182483 | | 6/2002 |
| JP | 2002-316756 | | 10/2002 |
| JP | 2002316756 A | * | 10/2002 |
| JP | 2007-008677 | | 1/2007 |
| JP | 2007-193205 | | 8/2007 |
| JP | 2009-265421 | | 11/2009 |
| JP | 2010-072071 | | 4/2010 |

OTHER PUBLICATIONS

Office Action in corresponding Japanese Patent Application No. 2008-248588 mailed on Jun. 22, 2010.
Office Action in corresponding Japanese Patent Application No. 2008-236562 mailed on Jun. 22, 2010.

* cited by examiner

*Primary Examiner* — David Gray
*Assistant Examiner* — Joseph S Wong
(74) *Attorney, Agent, or Firm* — Banner & Witcoff, Ltd.

(57) ABSTRACT

A belt unit includes an endless belt, a drive roller, a follow roller, and a braking member. The drive roller drives the endless belt to move circularly. The follow roller rotates about a rotational shaft thereof following the circular movement of the endless belt. The rotational shaft extends in an axial direction and having two axial ends. The endless belt is wound around the drive roller and the follow roller. The braking member is disposed on one of the two axial ends and is rotatable about the rotational shaft and applies a rotational friction force to the endless belt when the endless belt is in frictional contact with the braking member.

19 Claims, 14 Drawing Sheets

BELT UNIT AND IMAGE FORMING DEVICE

CROSS REFERENCE TO RELATED APPLICATION

This application claims priority from Japanese Patent Application No. 2008-236562 filed on Sep. 16, 2008 and Japanese Patent Application No. 2008-248588 filed Sep. 26, 2008. The entire content of each of these priority applications is incorporated herein by reference.

TECHNICAL FIELD

The present invention relates to an image forming device, and more particularly to a belt unit of the image forming device in which an endless belt circularly moves.

BACKGROUND

A conventional belt unit of an image forming device is configured of an endless belt, a drive roller that drives the belt to circulate, and a follow roller that rotates following the circulation of the belt. The endless belt is stretched around the drive roller and the follow roller under tension.

In this belt unit, if tension is not applied to the endless belt uniformly in a widthwise direction thereof (i.e., in a direction perpendicular to a rotating direction as well as to a thickness direction of the belt), the belt may, while rotating, skew in a direction from a portion with greater tension toward a portion with smaller tension.

To this effect, in order to prevent the belt from being skewed, belt guides are normally provided on both widthwise ends of the belt such that the drive roller and the follow roller are interposed, respectively in axial directions thereof, between the belt guides.

However, the belt guides demand high quality in both wear resistance and friction coefficient, and are also made from quite expensive materials. Hence, production costs of the belt units tend to inevitably increase.

SUMMARY

In view of the foregoing, it is an object of the present invention to prevent a belt from getting skewed without employing belt guides.

In order to attain the above and other objects, there is provided a belt unit including an endless belt, a drive roller, a follow roller, and a braking member. The drive roller drives the endless belt to move circularly. The follow roller rotates about a rotational shaft thereof following the circular movement of the endless belt. The rotational shaft extends in an axial direction and having two axial ends. The endless belt is wound around the drive roller and the follow roller. The braking member is disposed on one of the two axial ends and is rotatable about the rotational shaft and applies a rotational friction force to the endless belt when the endless belt is in frictional contact with the braking member.

According to another aspect of the present invention, there is provided an image forming device including an image forming unit and a belt unit. The belt unit includes an endless belt, a drive roller, a follow roller, and a braking member. The drive roller drives the endless belt to move circularly. The follow roller rotates about a rotational shaft thereof following the circular movement of the endless belt. The rotational shaft extends in an axial direction and having two axial ends. The endless belt is wound around the drive roller and the follow roller. The braking member is disposed on one of the two axial ends and is rotatable about the rotational shaft and applies a rotational friction force to the endless belt when the endless belt is in frictional contact with the braking member.

BRIEF DESCRIPTION OF THE DRAWINGS

The particular features and advantages of the invention as well as other objects will become apparent from the following description taken in connection with the accompanying drawings, in which:

FIG. 10 is an exploded diagram of the transmission mechanism shown in

FIG. 9;

DETAILED DESCRIPTION

Figure 1:
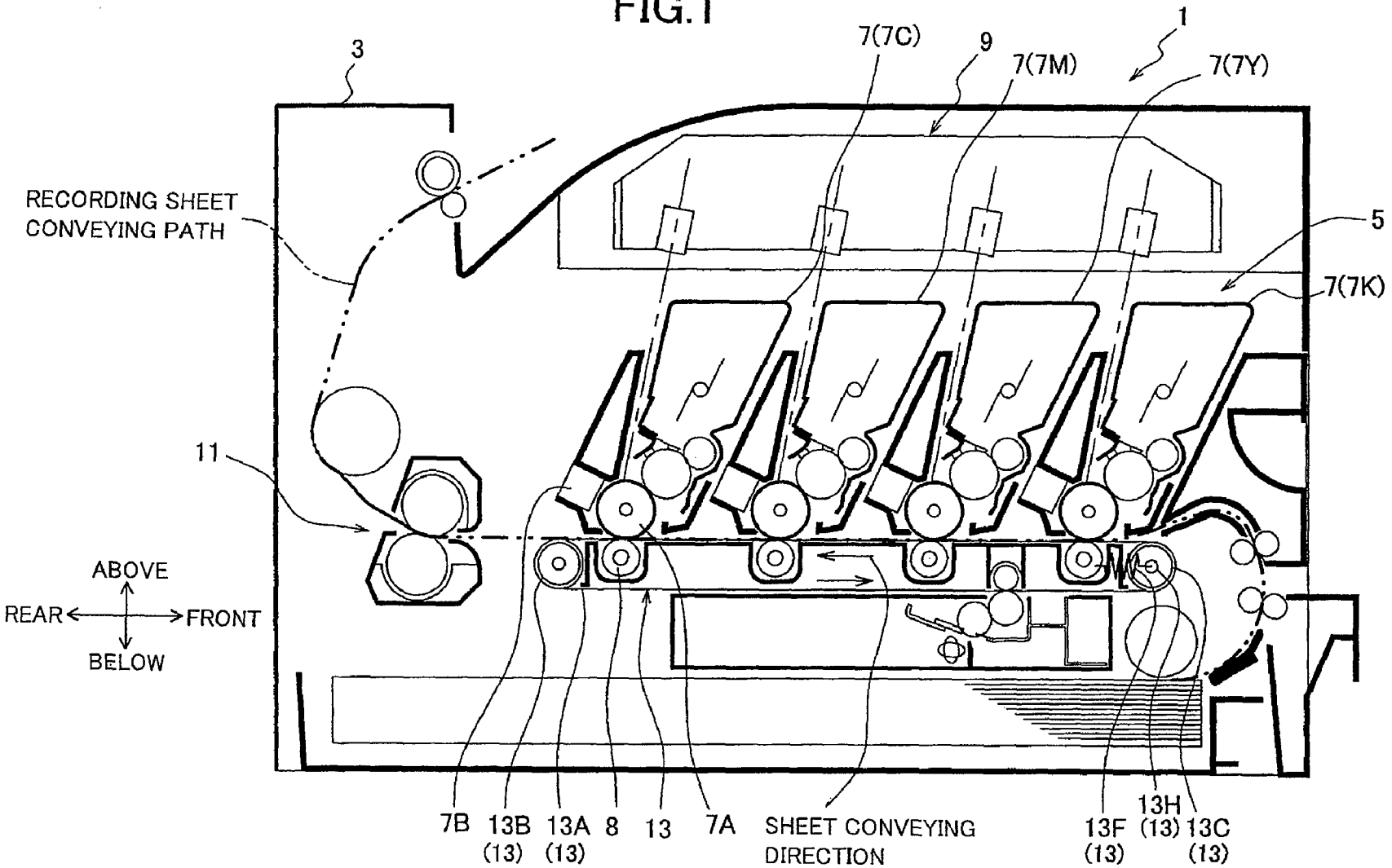
FIG. 1 is a central cross-sectional view illustrating a general configuration of an image forming device according to a first embodiment of the present invention.

A belt unit according to a first through seventh embodiments of the invention and an image forming device 1 provided with a belt unit will be described while referring drawings to wherein like parts and components are designated by the same reference numerals to avoid duplicating description. The terms "above", "below", "right", "left", "front", "rear" and the like will be used throughout the description assuming that the image forming device 1 is disposed in an orientation in which it is intended to be used. In use, the image forming device 1 is disposed as shown in FIG. 1. Note that, throughout the description, orientations will be referred to as shown in the drawings unless otherwise stated.

First of all, a configuration of the image forming device 1 including a belt unit 13 according to a first embodiment will be described with reference to FIGS. 1 through 4. As shown in FIG. 1, the image forming device 1 is a direct tandem-type color laser printer, including a casing 3, an image forming unit 5 accommodated in the casing 3 and the belt unit 13. The image forming unit 5 employs an electrophotographic system in which images are formed on recording mediums such as recording sheets or transparencies (hereinafter referred to as 'sheets') by transferring developers thereon.

The image forming unit 5 includes process cartridges 7, an exposing section 9 and a fixing section 11, as shown in FIG. 1. A plurality of process cartridges 7 (four process cartridges in the present embodiment) is juxtaposed in a direction along which the sheets are conveyed (hereinafter referred to as 'sheet conveying direction') in the image forming unit 5. More specifically, a process cartridge for black 7K, a process cartridge for yellow 7Y, a process cartridge for magenta 7M and a process cartridge for cyan 7C are arranged in the sheet conveying direction sequentially from upstream to downstream in this order.

The process cartridges 7 have a configuration identical to each other except in that each accommodates developer of a different color. Specifically, each process cartridge 7 is configured of a photosensitive drum 7A on which developer images are carried, and a charger 7B that charges the photosensitive drum 7A. In FIG. 1, reference numerals of the photosensitive drum 7A and the charger 7B are shown only in the process cartridge for cyan 7C for the sake of simplification.

Under the above-described configuration, charged photosensitive drums 7A are exposed to light by the exposing section 9, thereby forming electrostatic latent images on corresponding circumferential surfaces of the photosensitive drums 7A. Subsequently, charged developer is supplied to each of the photosensitive drums 7A, and developer images are borne (formed) on respective circumferential surfaces of the photosensitive drums 7A.

The belt unit 13 includes a transfer belt 13A and four transfer rollers 8. Each transfer roller 8 is disposed at a position opposing each of the photosensitive drums 7 via the transfer belt 13A, as shown in FIG. 1. The transfer rollers 8 transfer developer images formed on the photosensitive drums 7 onto the sheets conveyed by the transfer belt 13A. The sheets on which developer images are transferred are then conveyed to the fixing section 11 whereby the developer images are thermally fixed on the sheets.

A configuration of the belt unit 13 will now be described in greater detail with reference to FIGS. 1 to 2A. The belt unit 13 includes the transfer belt 13A, a drive roller 13B, a follow roller 13C and a frame (not shown) that supports the drive roller 13B and the follow roller 13C. The belt unit 13 is detachably mountable in the image forming device 1.

The transfer belt 13A is an endless belt formed of a resin material (in the present embodiment, thermoplastic elastomer) and wound or stretched around the drive roller 13B and the follow roller 13C. The drive roller 13B rotates because of driving force transmitted from an electric motor (not shown). The rotation of the drive roller 13B drives the transfer belt 13A to move circularly. The follow roller 13C rotates following the circular movement of the transfer belt 13A.

Figure 2A:
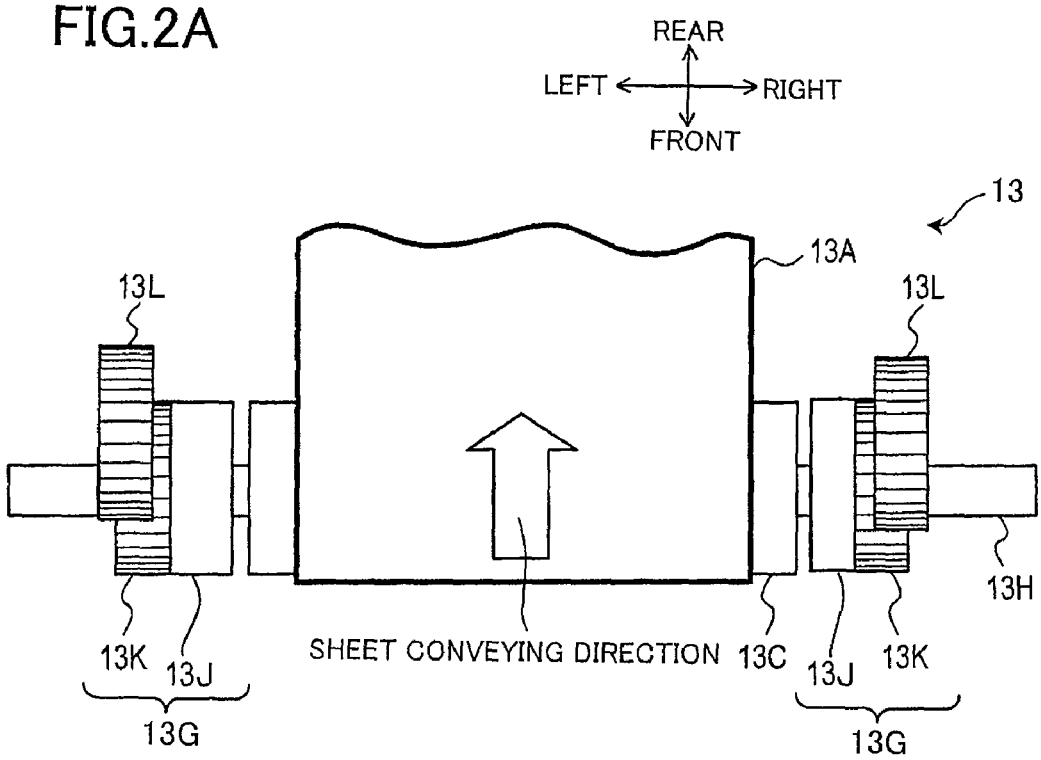
FIG. 2A is a diagram illustrating features of a belt unit according to the first embodiment of the present invention.
Figure 3:
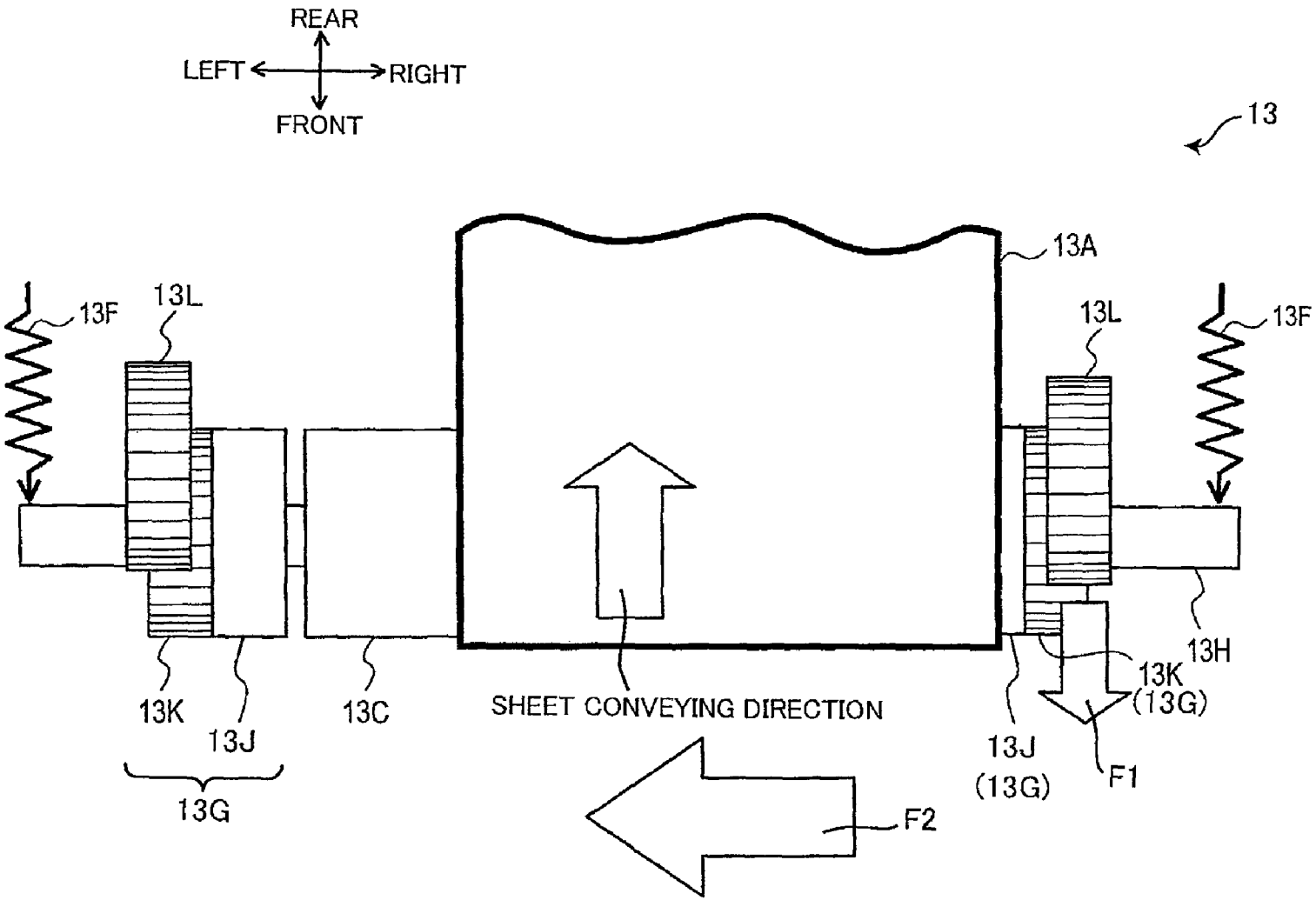
FIG. 3 is an explanatory diagram showing operations of the belt unit according to the first embodiment of the present invention.

As shown in FIGS. 2A and 3, the follow roller 13C is provided with a rotational shaft 13H extending hi an axial direction thereof and having two axial ends. The follow roller 13C is assembled to the frame such that the rotational shaft 13H is allowed to displace in a first direction perpendicular to the axial direction (i.e., a rear-to-front direction in the first embodiment) and a second direction opposite the first direction. That is, in the first direction, tension accrued on the transfer belt 13A increases. The rotational shaft 13H is biased by a compression coil spring 13F in the first direction in which the tension imparted on the transfer belt 13A increases (rear-to-front direction). In other words, the compression coil spring 13F presses rotational shaft 13H in the first direction. With the compression coil spring 13F, the rotational shaft 13H is moved away from the drive roller 13B when the rotational shaft 13H is moved in the first direction, and is moved toward the drive roller 13B when the rotational shaft 13H is moved in the second direction. Therefore, the compression coil spring 13F maintains a tension imparted on the endless belt constant. The follow roller 13C also serves as a tension roller that applies a prescribed tension to the transfer belt 13A. Due to frictional force generated between the transfer belt 13A and the drive roller 13B, the transfer belt 13A can move at a constant speed, without sliding relative to the drive roller 13B, following the rotation of the drive roller 13B.

As shown in FIG. 2A, two tension roller collars 13G are provided at both axial ends of the follow roller 13C. The tension roller collars 13G are rotatably mounted on the rotational shaft 13H of the follow roller 13C. When the transfer belt 13A moves in the axial direction toward an end of the follow roller 13C and makes contact with one of the tension roller collars 13G, as shown in FIG. 3, these tension roller collars 13G serve as a braking member that rotates about the rotational shaft 13H in accordance with the circular movement of the transfer belt 13A and applies a rotational friction force to the transfer belt 13A when the transfer belt 13A is in frictional contact with the tension roller collar 13G. In other words, as shown in FIG. 2A, each tension roller collar 13G has a circular cylindrical shape with a diameter substantially equal to that of the follow roller 13C, and is supported on the rotational shaft 13H so as to be rotatable relative to the same.

Each tension roller collar 13G has an outer circumferential surface on which a friction surface 13J and a gear section 13K are formed. Each tension roller collar 13G is mounted on the rotational shaft 13H such that the friction surface 13J is closer to the follow roller 13C than the gear section 13K is. The friction surface 13J receives the rotational force of the transfer belt 13A when in contact with inner circumferential surface of the transfer belt 13A.

Figure 2B:
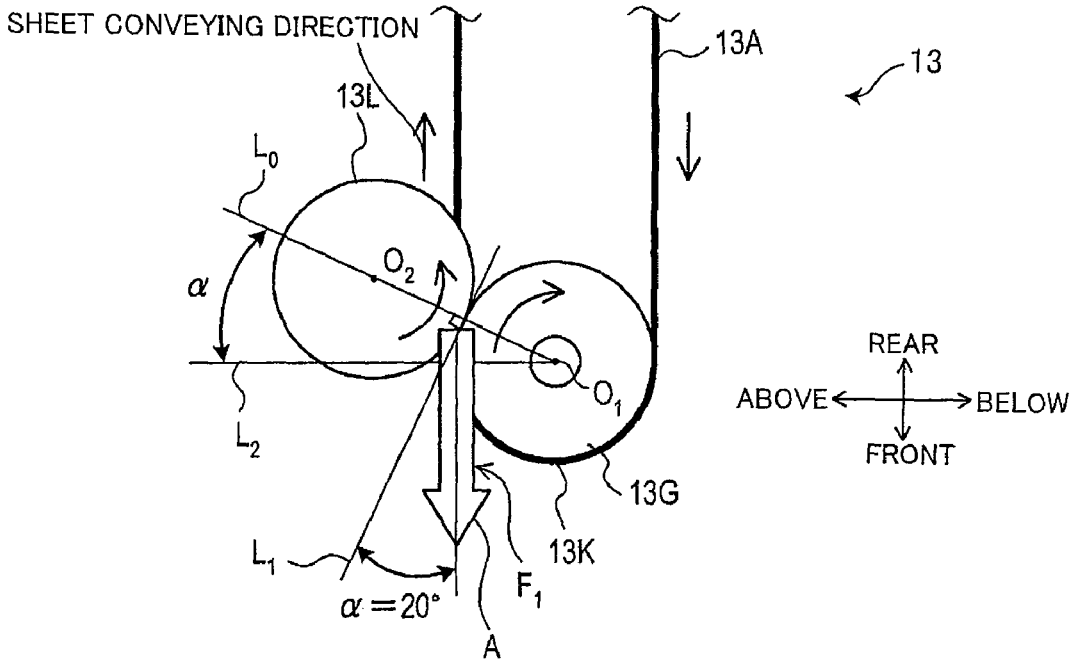
FIG. 2B is a right side view of the belt unit shown in FIG. 2A.

The gear section 13K is formed of spur gear teeth. As illustrated in FIG. 2B, a damper gear 13L is coupled to each gear section 13K. The damper gear 13L meshingly engages the corresponding gear section 13K so that the damper gear 13L can impart rotational friction force or rotational resistance on the corresponding tension roller collar 13G while rotating. In other words, the damper gear 13L is rotatable about an axis and applies a rotational force to the tension roller collar 13G while the damper gear 13L is rotating and in contact with the tension roller collar 13G. Within the damper gear 13L, oil is sealed for generating viscosity resistance. This viscosity resistance enables the damper gear 13L to serve as a rotational force applying member for applying rotational force to the tension roller collar 13G. The tension roller collar 13G applies the rotational friction force to the transfer belt 13A based on the rotational force applied by the damper gear 13L.

The damper gear 13L is arranged such that a reaction force F1 includes a component generated in the first direction. The first direction is a direction in which the tension applied to the transfer belt 13A is to increase, and is a direction from rear to front. Note that, the reaction force F1 is generated at a position where the damper gear 13L meshingly engages the tension roller collar 13G when the damper gear 13L is in contact with the tension roller collar 13G. In other words, the tension roller collar 13G receives the reaction force F1 from the damper gear 13L at the position where the damper gear 13L and the tension roller collar 13G are in engagement with each other. The reaction force F1 acts in a direction indicated by an arrow A in FIG. 2B opposite to a rotating direction of the tension roller collar 13G.

As shown in FIG. 2B, the direction in which the reaction force F1 acts is defined as a direction inclined an angle corresponding to a pressure angle α of the gear section 13K relative to a straight line L1. The straight line L1 is a line extending in a direction perpendicular to a first reference line L0. The first reference line L0 is defined as a straight line passing through a rotational center O1 of the tension roller collar 13G and a rotational center O2 of the damper gear 13L.

In the first embodiment, the damper gear 13L is arranged such that the pressure angle α is determined to be an angle formed between the first reference line L0 and a second reference line L2, and also such that the reaction force F1 acts on the tension roller collar 13G in a direction toward the follow roller 13C from the drive roller 13B. The second reference line L2 is an imaginary line extending in a direction orthogonal to the first direction (i.e., the above-to-below direction) while passing through the rotational center O1 of the tension roller collar 13G.

With the above-described configuration, the tension roller collars 13G are provided at the axial ends of the follow rollers 13C for generating a rotational friction force greater than that of the follow rollers 13C in the first embodiment. Therefore, as shown in FIG. 3, if the transfer belt 13A is being skewed and a peripheral end portion of the transfer belt 13A is brought into contact with either tension roller collar 13G, the reaction force F1 is imparted, as a braking force to stop the transfer belt 13A moving in the sheet conveying direction, on the end portion of the transfer belt 13A which has touched the tension roller collar 13G. Since the reaction force F1 has a component generated in the first direction, tension imparted on the end portion of the transfer belt 13A is to be increased. In other words, the end portion of the transfer belt 13A receives the rotational force by subtracting the reaction force F1 from the rotational force applied by the follow roller 13C. However, other portion of the transfer belt 13A that does not touch the tension roller collar 13G receives the rotational force applied by the follow roller 13C. A difference in rotational force between the end portion of transfer belt 13A and the other portion thereof causes the end portion to move slower than the other portion.

In response, the transfer belt 13A receives a correction force having a component F2 in the axial direction toward a center of the follow roller 13C from the tension roller collar 13G side. In other words, the transfer belt 13A is started to move toward a center of the follow roller 13C from the tension roller collar 13G side, that is, from a portion with greater tension to a portion with smaller tension in the transfer belt 13A. In this way, the skew in the transfer belt 13A can be corrected.

In the first embodiment, since the tension roller collars 13G are provided in the axial direction of the follow roller 13C, skew can be reliably addressed in the transfer belt 13A, regardless of directions of the skew.

Further, in the first embodiment, when the transfer belt 13A is skewed and is in contact with the tension roller collar 13G, the skew is corrected by the braking force F1 applied to the end portion of the transfer belt 13A that has contacted the tension roller collar 13G. Hence, there arises a need to reliably impart the braking force F1 to the portion at which the transfer belt 13A and the tension roller collar 13G contact, i.e., the friction surface 13J. In the first embodiment, therefore, the friction surface 13J is given a friction coefficient greater than that of the follow roller 13C. With this configuration, the braking force is ensured to be imparted on the transfer belt 13A from the tension roller collar 13G.

Further, in the first embodiment, when the transfer belt 13A is skewed and is in contact with one of the tension roller collars 13G, the reaction force F1 becomes active only on a portion of the transfer belt 13A that is positioned on the contacted tension roller collar 13G side (hereinafter referred to as "contact side"), but not on the other tension roller 13G that is not in contact with the transfer belt 13A. In addition, the rotating shaft 13H of the follow roller 13C is supported to be movable in the first direction (rear-to-front direction) substantially perpendicular to the axial direction thereof and the second direction opposite the first direction (front-to-rear direction). Hence, due to the reaction force F1, the rotating shaft 13H on the contact side is urged to displace in the first direction away from the drive roller 13B. In this way, tension becomes greater toward the contact side in the transfer belt 13A. The transfer belt 13A is therefore started to move toward the center of the follow roller 13C from the tension roller collar 13G side, that is, from a portion with greater tension to a portion with smaller tension with respect to the widthwise direction in the transfer belt 13A. In this way, the skew in the transfer belt 13A can be reliably addressed.

As described above, the tension applied to the transfer belt 13A is to increase because of the braking force F1 applied to the transfer belt 13A as well as the displacement of the rotational shaft 13H of the follow roller 13C in the direction away from the drive roller 13B. The skew in the transfer belt 13A is thus reliably addressed.

Note that, the follow roller 13C displaces in response to the reaction force F1, while the damper gear 13L remains stationary. However, since the amount of displacement of the follow roller 13C is marginal, the meshing engagement between the damper gear 13L and the gear section 13K will not be released because of the displacement of the follow roller 13C.

Further, in the first embodiment, the follow roller 13C also serves as a tension roller that applies tension to the transfer belt 13A. At the same time, tension roller collars 13G are provided on axial ends of the follow roller 13C serving as a tension roller. Therefore, the skew is to be effectively suppressed from occurring in the transfer belt 13A.

Further, in the first embodiment, the reaction force F1 generated at a place where the gear section 13K and the damper gear 13L meshingly engage enables the tension of the transfer belt 13A to increase. Hence, the displacement of the follow roller 13C can reliably facilitate increase in the tension.

Note that the pressure angle α of the gear section 13K in the present embodiment is determined to be 20°. Hence, as shown in FIG. 4B, an angle formed between the first reference line L0 and the second reference line L2 is set to be 20° so that the reaction force F1 can be effectively utilized in increasing the tension of the transfer belt 13A.

Figure 4A:
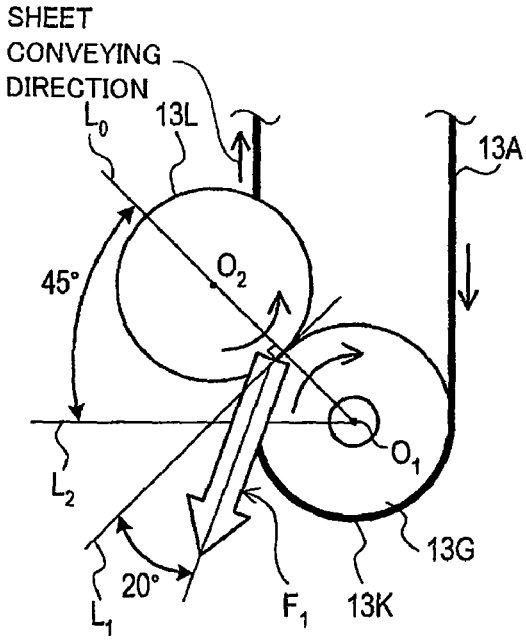
FIG. 4A is a diagram illustrating relationships between a reaction force F1 and an angle formed by a first reference line L0 and a second reference line L2, the angle being set to 45°.
Figure 4B:
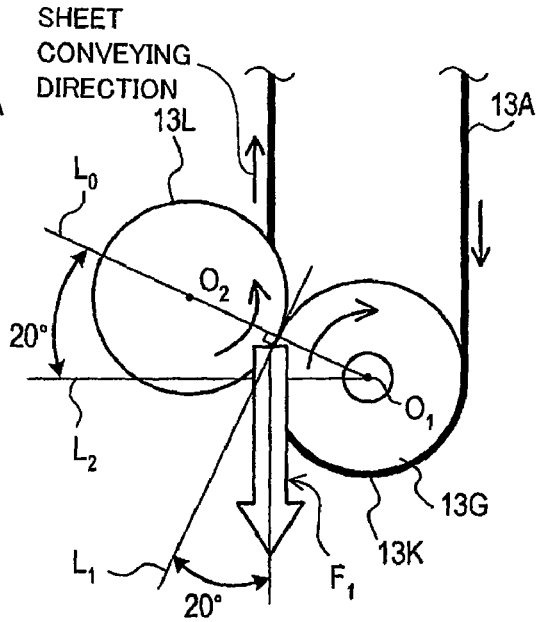
FIG. 4B is a diagram illustrating relationships between a reaction force F1 and an angle formed by a first reference line L0 and a second reference line L2, the angle being set to 20°.
Figure 4C:
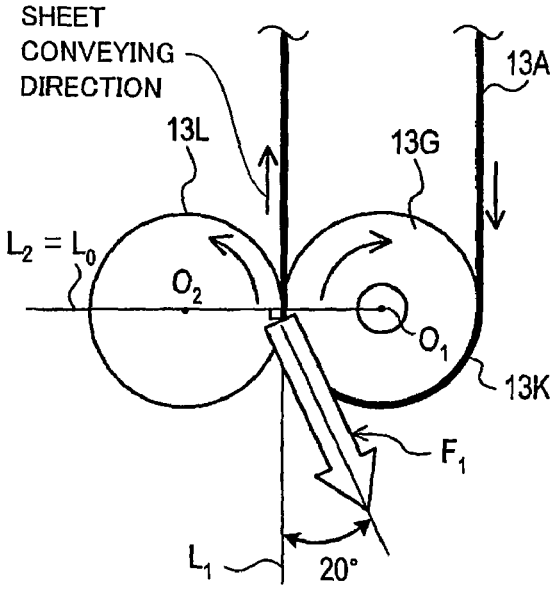
FIG. 4C is a diagram illustrating relationships between a reaction force F1 and an angle formed by a first reference line L0 and a second reference line L2, the angle being set to 0°.
Figure 4D:
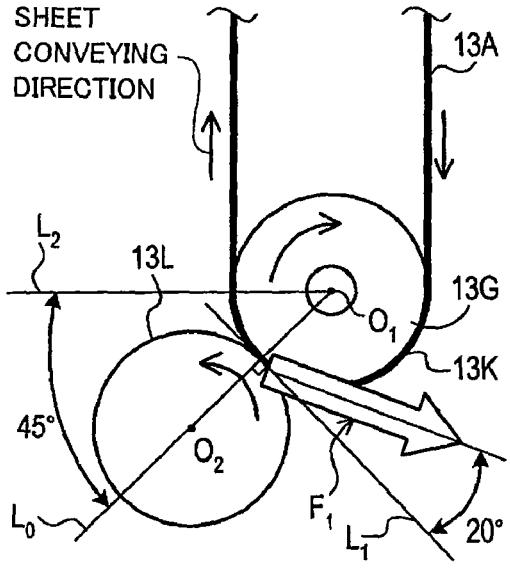
FIG. 4D is a diagram illustrating relationships between a reaction force F1 and an angle formed by a first reference line L0 and a second reference line L2, the angle being set to 45°.

Also note that if the angle formed between the first reference line L0 and the second reference line L2 can be set to angles other than 20° as shown in FIGS. 4A, 4C, and 4D, the generated reaction force F1 can contain a component in the direction in which the tension of the transfer belt 13A is to increase. However, if the pressure angle α is not employed, the reaction force F1 cannot be fully utilized. Therefore, the angle formed between the first reference line L0 and the second reference line L2 is equal to the pressure angle α preferably.

Figure 5:
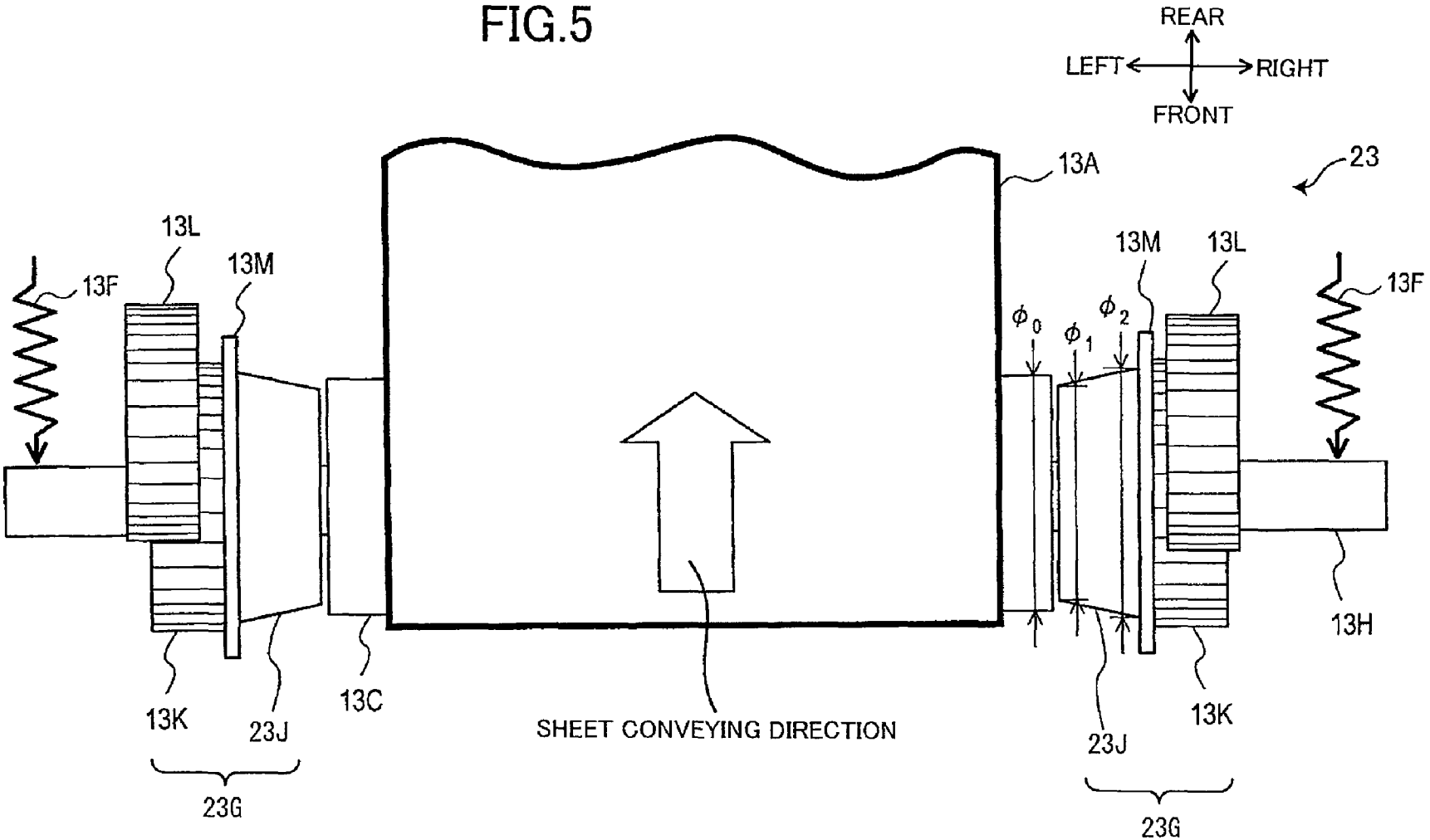
FIG. 5 is a diagram illustrating features of a belt unit according to a second embodiment of the present invention.

A belt unit 23 according to a second embodiment of the present invention will be described next while referring to FIG. 5. The belt unit 23 has substantially same construction as the belt unit 13 according to the first embodiment. While each tension roller collar 13G (the friction surface 13J) has a constant diameter in the first embodiment, the belt unit 23 includes each tension roller collar 23G having a friction surface 23J that is formed in a tapered shape as shown in FIG. 5. That is, in the second embodiment, the friction surface 23J is formed such that a diameter ϕ1 be smaller than a diameter ϕ2. In other words, the tension roller collar 23G includes a part formed in a circular truncated cone shape that has a first end and a second end that is disposed nearer to the follow roller 13C. The diameter ϕ1 is a diameter of the friction surface 23J closer to the follow roller 13C, while a diameter of the friction surface 23J closer to the gear section 13K is designated as the diameter ϕ2.

Further, in the second embodiment, the diameter ϕ1 is designed to be smaller than a diameter ϕ0 of the follow roller 13C, whereas the diameter ϕ2 is set to be larger than ϕ0. In addition, each tension roller collar 23G is provided with a flange 13M at a position between the friction surface 23J and the gear section 13K. The flange 13M protrudes in a radial direction of the tension roller collar 23G along the entire circumference of the flange 13M.

With the above-described configuration, when the transfer belt 13A gets skewed and moves toward either tension roller collar 23G side from the follow roller 13C, the transfer belt 13A is allowed to move smoothly onto the friction surface 23J, thereby preventing the transfer belt 13A from being damaged in the process.

Further, in the second embodiment, the friction surface 23J is formed in a tapered-shape with the diameter ϕ1 being smaller than the diameter ϕ2. Therefore, as the skew in the transfer belt 13A becomes greater, the transfer belt 13A receives the greater braking force F1 and the greater tension. Accordingly, the skew in the transfer belt 13A can be efficiently suppressed.

In the second embodiment, the diameter ϕ1 of the friction surface 23J is set to be smaller than the diameter ϕ0 of the follow roller 13C, and the diameter ϕ2 of the friction surface 23J is determined to be larger than the diameter ϕ0. However, the second embodiment is not limited to the above-described configuration. For example, as a variation, the diameter ϕ1 may be adjusted to be equal to the diameter ϕ0, or alternatively, the diameter ϕ2 may be designed to be equal to the diameter ϕ0.

Next, a belt unit 33 according to a third embodiment of the present invention will be described with reference to FIGS. 6 and 7. In the first and second embodiments, the tension roller collars 13G and 23G, serving also as a tension roller, are provided on both axial ends of the follow roller 13C. In the third embodiment, however, as shown in FIG. 6, a tension roller 13N is provided in the belt unit 33, separate from the follow roller 13C, for exclusively applying tension to the transfer belt 13A.

Figure 6:
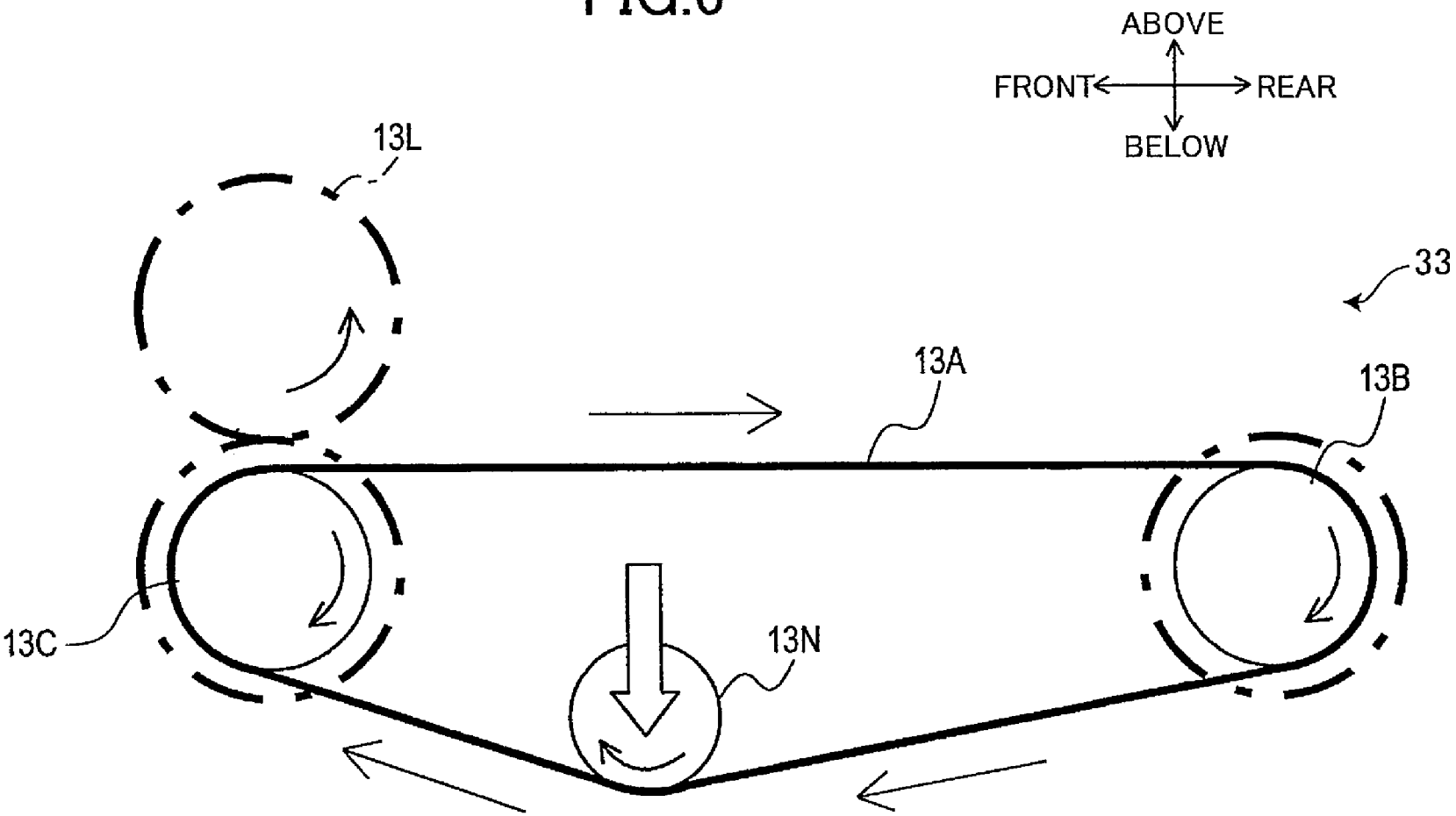
FIG. 6 is a diagram illustrating features of a belt unit according to a third embodiment of the present invention.

In other words, in the third embodiment, the follow roller 13C is rotatably supported to the frame but positionally-fixed, just like the drive roller 13B, as shown in FIG. 6. Instead, the tension roller 13N is configured to be movable in a direction (in this embodiment, above-to-below direction) substantially orthogonal to an axial direction thereof so that tension can be applied to the transfer belt 13A. In other words, the tension roller 13N maintains the tension imparted on the endless belt 13A.

Figure 7:
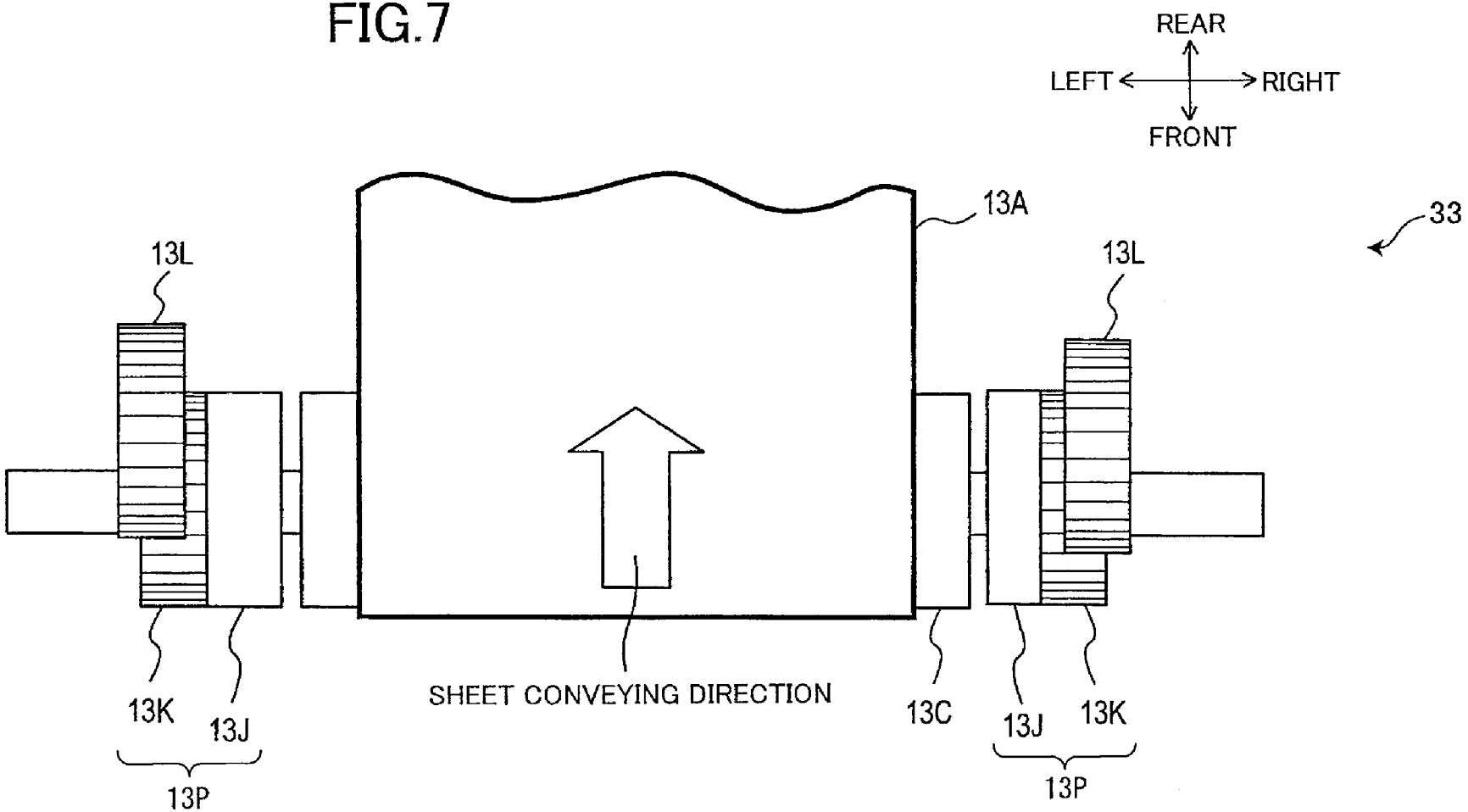
FIG. 7 is a diagram illustrating other features of the belt unit according to the third embodiment.

Note that, since the follow roller 13C according to the third embodiment does not function as a tension roller, follow roller collars 13P are shown in FIG. 7 instead of the tension roller collars 13G. However, the follow roller collars 13P have a configuration the same as that of the tension roller collars 13G.

In the third embodiment, just as in the first and second embodiment, the braking force from the follow roller collar 13P acts on the transfer belt 13A at the contact side thereof and thus the tension at the contact side of the transfer belt 13A is increased. Hence, the transfer belt 13A is allowed to move, in the widthwise direction, from the follow roller collar 13P side which has higher tension, toward the center of the transfer belt 13A which has smaller tension. The skew in the transfer belt 13A is thus to be addressed.

The follow roller collar 13P shown in FIG. 7 has a simple cylindrical shape as in the first embodiment. However, as in the second embodiment, the friction surface 13J of the follow roller collar 13P may have a tapered-shape.

In the first, second and third embodiments, the tension roller collars 13G and 23G and the follow roller collars 13P are disposed on both axial ends of the follow roller 13C, but the present invention is not confined to this configuration. The tension roller collar 13G and 23G and the follow roller collars 13P may be provided on one of the axial ends of the follow roller 13C.

Further, in the first, second and third embodiments, the damper gear 13L applies the braking force F1 to the tension roller collars 13G and 23G (follow roller collars 13P) via the gear section 13K. But, as a variation, the damper gear 13L may impart the braking force on the tension roller collar 13G (follow roller collar 13P) via a belt or friction force without providing the gear section 13K.

Further, the damper gear 13L may utilize friction force, instead of viscosity resistance of oil as employed in the first, second and third embodiments.

Further, the damper gear 13L applies rotational friction force to the tension roller collar 13G, 23G (follow roller collar 13P) in the first, second and third embodiments. However, instead, there may be provided a bearing that rotatably supports the tension roller collar 13G, 23G (follow roller collar 13P) for generating predetermined rotational friction force.

Further, in the first, second and third embodiments, the angle formed between the first reference line L0 and the second reference line L2 is set to be 20°, but this angle may be configured to be an angle other than 20° (pressure angle α) as shown in FIGS. 4A, 4C, and 4D.

Figure 8:
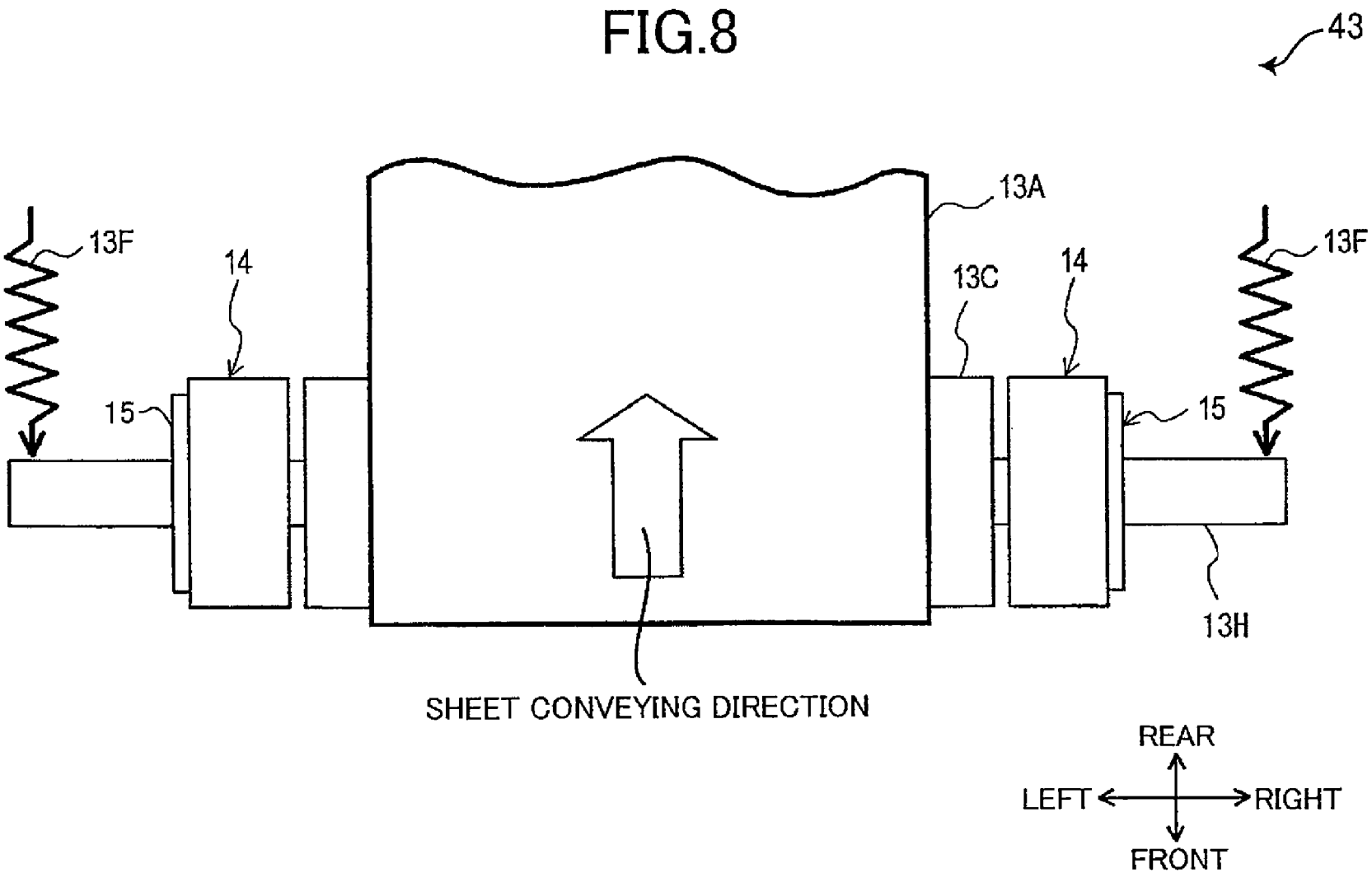
FIG. 8 is a diagram illustrating features of a belt unit according to a fourth embodiment of the present invention.

Next, a belt unit 43 according to a fourth embodiment of the present invention will be described with reference to FIGS. 8 through 11. In the fourth embodiment, as shown in FIG. 8, instead of the tension roller collars 13G and the damper gears 13L, the belt unit 43 includes tension collars 14 that are provided on both axial ends of the rotational shaft 13H of the follow roller 13C and rotatable about the rotational shaft 13H. The tension collar 14 is a braking member that rotates in accordance with rotational movement of the follow roller 13C at a circumferential speed smaller than that of the follow roller 13C. Note that the compression coil spring 13F is omitted in FIGS. 9 and 10.

Figure 9:
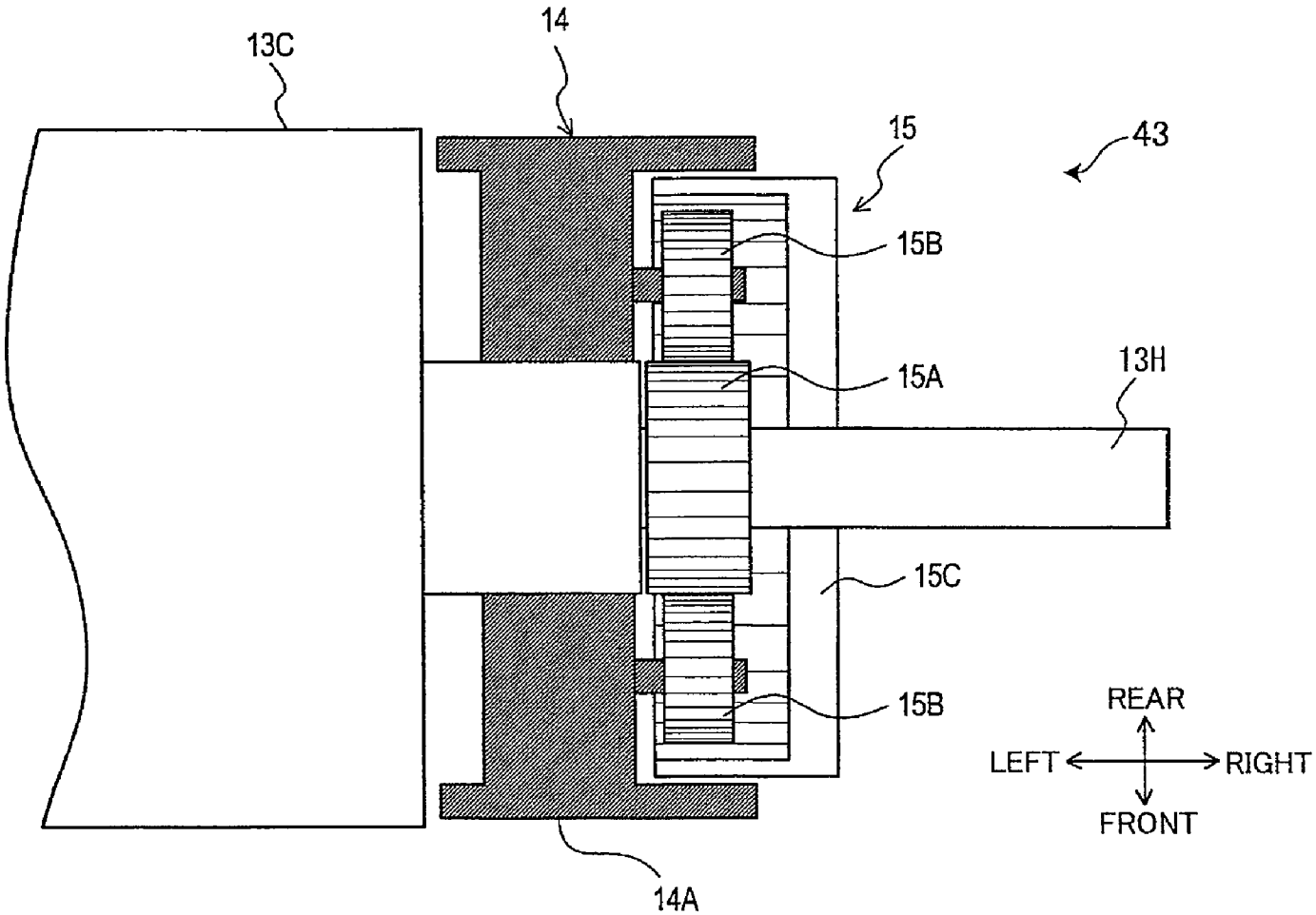
FIG. 9 is a diagram illustrating a transmission mechanism provided in the belt unit according to the fourth embodiment.

That is, as shown in FIG. 9, each tension collar 14 is formed in a cylindrical shape having a diameter substantially equal to that of the follow roller 13C. The tension collar 14 is supported around the rotational shaft 13H of the follow roller 13C such that the tension collar 14 can rotate relative to the rotational shaft 13H.

Each tension collar 14 has an outer circumferential surface on which a friction surface 14A is formed. When the transfer belt 13A moves toward either tension collar 14 (see FIG. 11), the friction surface 14A contacts the inner circumferential surface of the transfer belt 13A. The friction coefficient of the friction surface 14A is determined to be larger than that of the portion of the follow roller 13C which is in frictional contact with the transfer belt 13A. The tension collar 14 rotates when receiving driving force from the follow roller 13C via a speed reduction mechanism 15. The speed reduction mechanism 15 serves to decelerate rotational force of the rotational shaft 13H.

Figure 10:
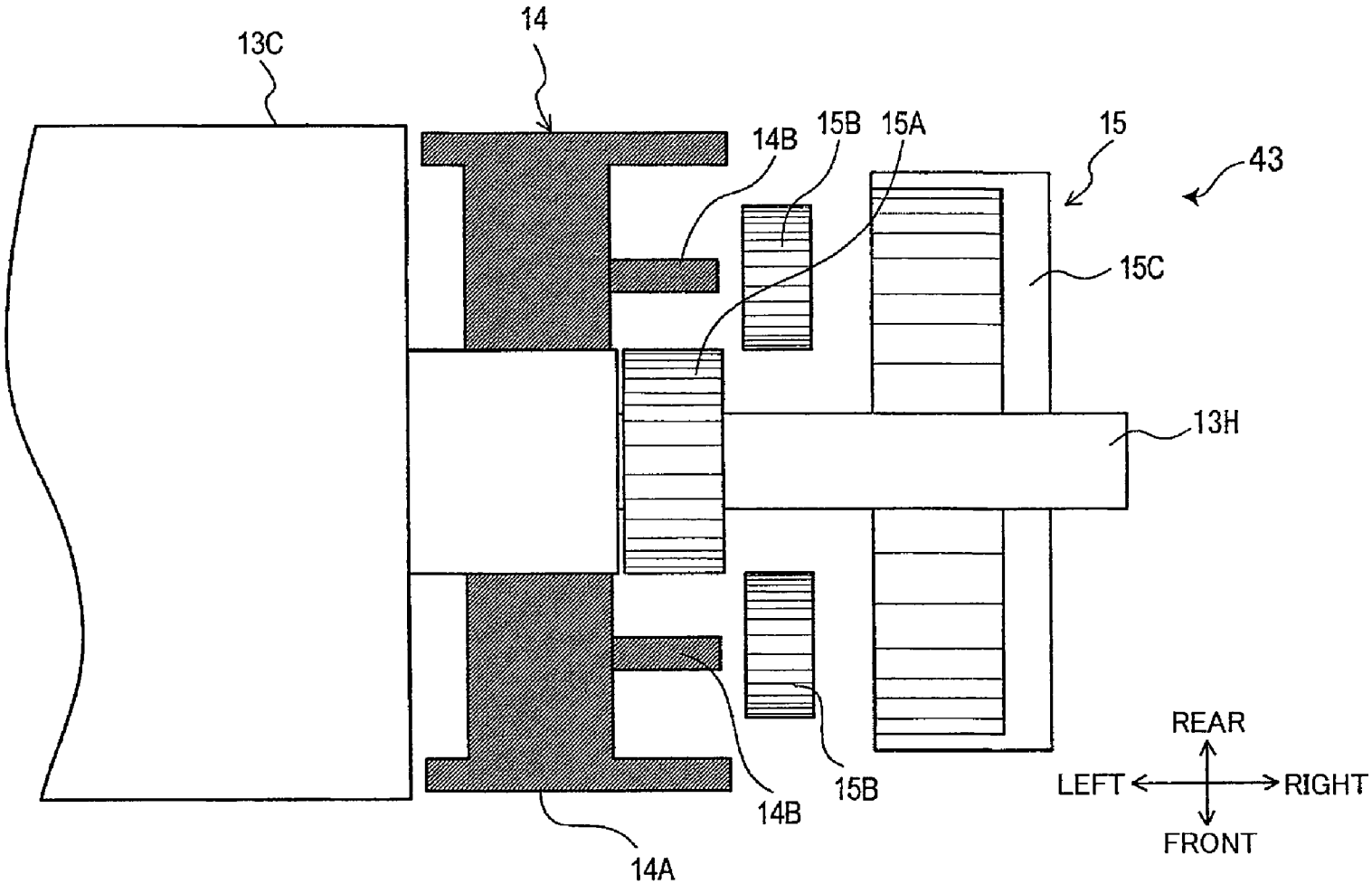

As shown in FIGS. 9 and 10, the speed reduction mechanism 15 employs a planetary gear train configured of a sun gear 15A, planetary gears 15B and an outer gear 15C. The sun gear 15A rotates in conjunction with the rotational movement of the rotational shaft 13H. Each tension collar 14 is formed with shafts 14B extending in the left-to-right direction (FIG. 10). The planetary gears 15B are rotatably supported on the shafts 14B while meshingly engaging the sun gear 15A. The outer gear 15C has an inner surface formed of gear teeth. The outer gear 15C is mounted on the frame (not shown) of the belt unit 43 such that the outer gear 15C does not rotate relative to the rotational shaft 13H which is allowed to displace in the first direction.

Note that, the speed reduction mechanism 15 according to the fourth embodiment is given a reduction ratio of 0.3-0.5, because the planetary gear 15B has an outline dimension smaller than that of the sun gear 15A. That is, one turn of the sun gear 15A results in 0.3-0.5 turns of the tension collar 14 that serves as a carrier supporting the planet gears 15B.

Accordingly, when the rotational shaft 13H of follow roller 13C rotates, the rotational force is transmitted to the planetary gears 15B via the sun gear 15A. Upon receipt of the rotational force, each planetary gear 15B rotates about the corresponding shaft 14B while simultaneously revolving around the rotational shaft 13H. As a response, the tension collar 14 serving as the carrier of the planetary gears 15B starts to rotate with a delay behind the follower roller 13C in a direction the same as the rotational direction of the rotational shaft 13H.

As described above, in the fourth embodiment, the tension collars 14 are provided on both axial ends of the follow roller 13C. The tension collar 14 rotates, following the rotational movement of the follow roller 13C, at the circumferential speed smaller than that of the follow roller 13C. Hence, as shown in FIG. 11, when the transfer belt 13A is skewed and a peripheral portion thereof is in contact with either tension collar 14, the portion of the transfer belt 13A that touches the tension collar 14 (hereinafter to be called as 'contact portion') is then subject to the braking force acting in such a direction that the transfer belt 13A is to stop moving, because of the difference in the circumferential speed between the inner circumferential surface of the transfer belt 13A and the friction surface 14A of tension collar 14.

Hence, tension generated on the contact portion becomes greater in the transfer belt 13A. The transfer belt 13A is therefore started to move toward the center thereof from the tension collar 14 side, that is, from a portion with greater tension to a portion with smaller tension in the widthwise direction in the transfer belt 13A. In this way, the skew in the transfer belt 13A can be addressed.

Further, in the fourth embodiment, since the tension collars 14 are provided on both axial ends of the follow roller 13C, skew can be reliably corrected in the transfer belt 13A, regardless of the directions of the skew.

Figure 11:
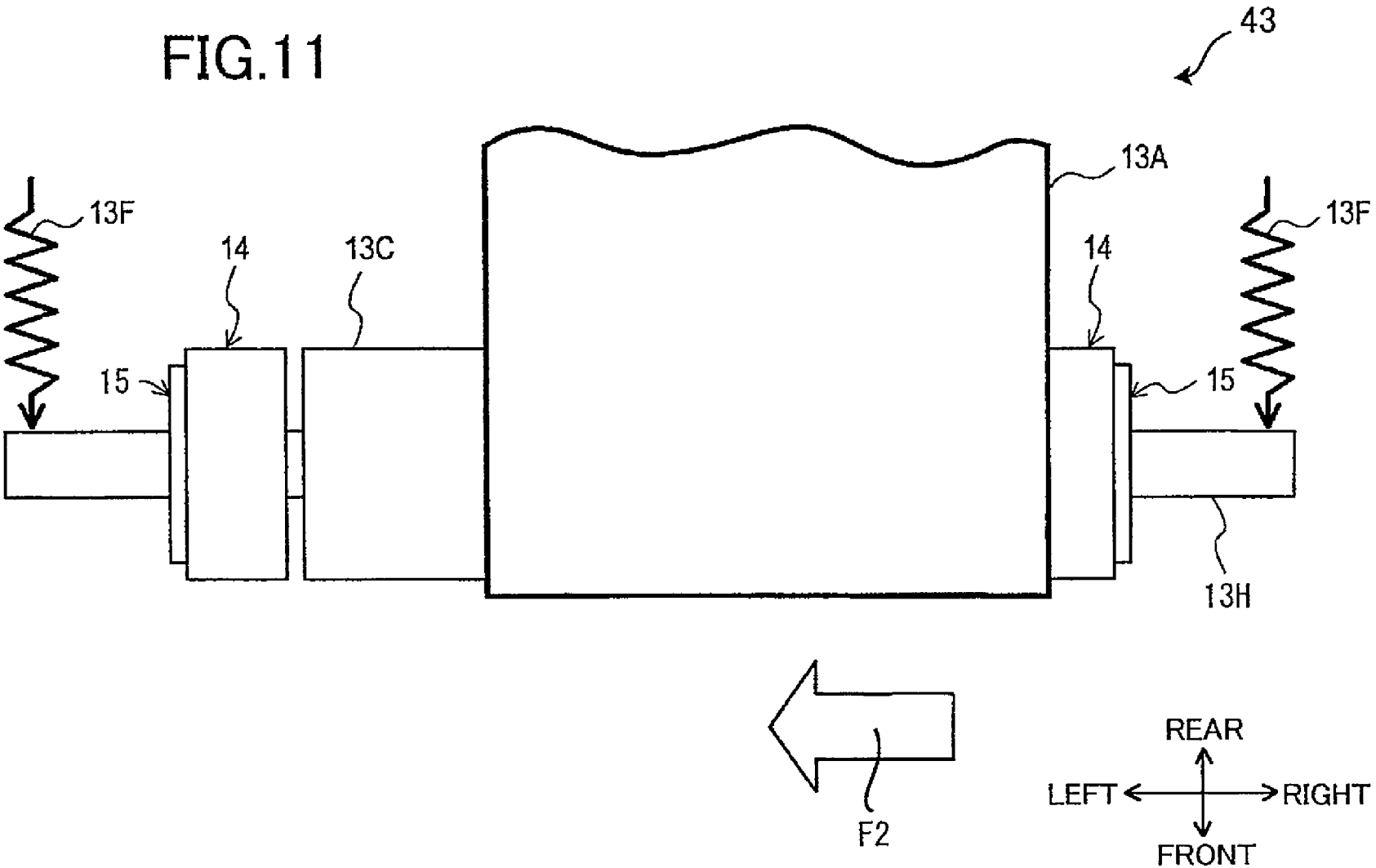
FIG. 11 is an explanatory diagram showing operations of the belt unit according to the fourth embodiment.

Note that, when the transfer belt 13A is skewed and is in contact with either tension collar 14, the correction force having the component F2 shown in FIG. 11 is generated by the braking force applied to the contact portion of the transfer belt 13A, and then the skew is corrected. Hence, there arises a need to reliably impart the braking force to the contact portion of the transfer belt 13A and the friction surface 14A of tension collar 14.

In the fourth embodiment, therefore, the friction surface 14A is given a friction coefficient greater than that of the outer circumferential surface of the follow roller 13C which contacts the transfer belt 13A. With this configuration, the braking force is ensured to be imparted on the transfer belt 13A from the tension collar 14.

Further, the follow roller 13C also serves as a tension roller that applies tension to the transfer belt 13A. At the same time, tension collars 14 are provided on both axial ends of the follow roller 13C serving as a tension roller. Therefore, skew is to be effectively suppressed in the transfer belt 13A.

Further in the fourth embodiment, the speed reduction mechanism 15 transmits the rotational force inputted from the follow roller 13C to the tension collar 14 such that the tension collar 14 rotates slower than the follow roller 13C. Hence, transmission of the rotational force is easily realized, if compared to, for example, a case where the rotational force is transmitted from the drive roller 13B.

Further, the speed reduction mechanism 15 is configured of the planetary gear train including the sun gear 15A that rotates with the rotational force obtained from the follow roller 13C. Hence, the speed reduction mechanism 15 can be made compact, while achieving a higher reduction ratio.

A belt unit 53 according to a fifth embodiment of the present invention will be described next with reference to FIG. 12. Instead of the speed reduction mechanism 15 configured of the planetary gear train in the fourth embodiment, the belt unit 53 includes speed reduction mechanisms 115 that are provided on both axial ends of the follow roller 13C. Each of the speed reduction mechanisms 115 includes a first gear 115D, a second gear 115E and a third gear 115F. The tension collar 14 has an outer circumferential surface on which a gear section 14C is formed at a side opposite to the friction surface 14A. The speed reduction mechanism 115 of the fifth embodiment transmits the rotational force of the rotational shaft 1311 to the gear section 14C at reduced speed.

More specifically, the first gear 115D is a spur gear that rotates in conjunction with the rotational shaft 13H. The first gear 115D meshingly engages the second gear 115E. The second gear 115E and the third gear 115F are arranged coaxially so that the third gear 115F can rotate synchronously with the second gear 115E. The rotational force of the first gear 115D is, therefore, first transmitted to the second gear 115E engaging the first gear 115D, and subsequently transmitted to the gear section 14C of the tension collar 14 via the third gear 115F. Note that the compression coil spring 13F is omitted in FIG. 12

Further, the second gear 115E and the third gear 115F may be rotatably supported to the frame of the belt unit 53. In this case, although the rotational shaft 13H is configured to displace, there is no likelihood that the tension of the transfer belt 13A would change so much that the meshing engagement between the first gear 115D and the gear section 14C would be released.

Alternatively, a movable shaft supporting member may be provided such that the shaft supporting member can displace in the first direction along with rotational shaft 13H, and the second gear 115E and the third gear 115F may be supported to the shaft supporting member. In this case, if the transfer belt 13A expands or contracts in the belt unit 53, the shaft supporting member can move in conjunction with the rotational shaft 13H, thereby preventing disengagement of respective gears.

Figure 13:
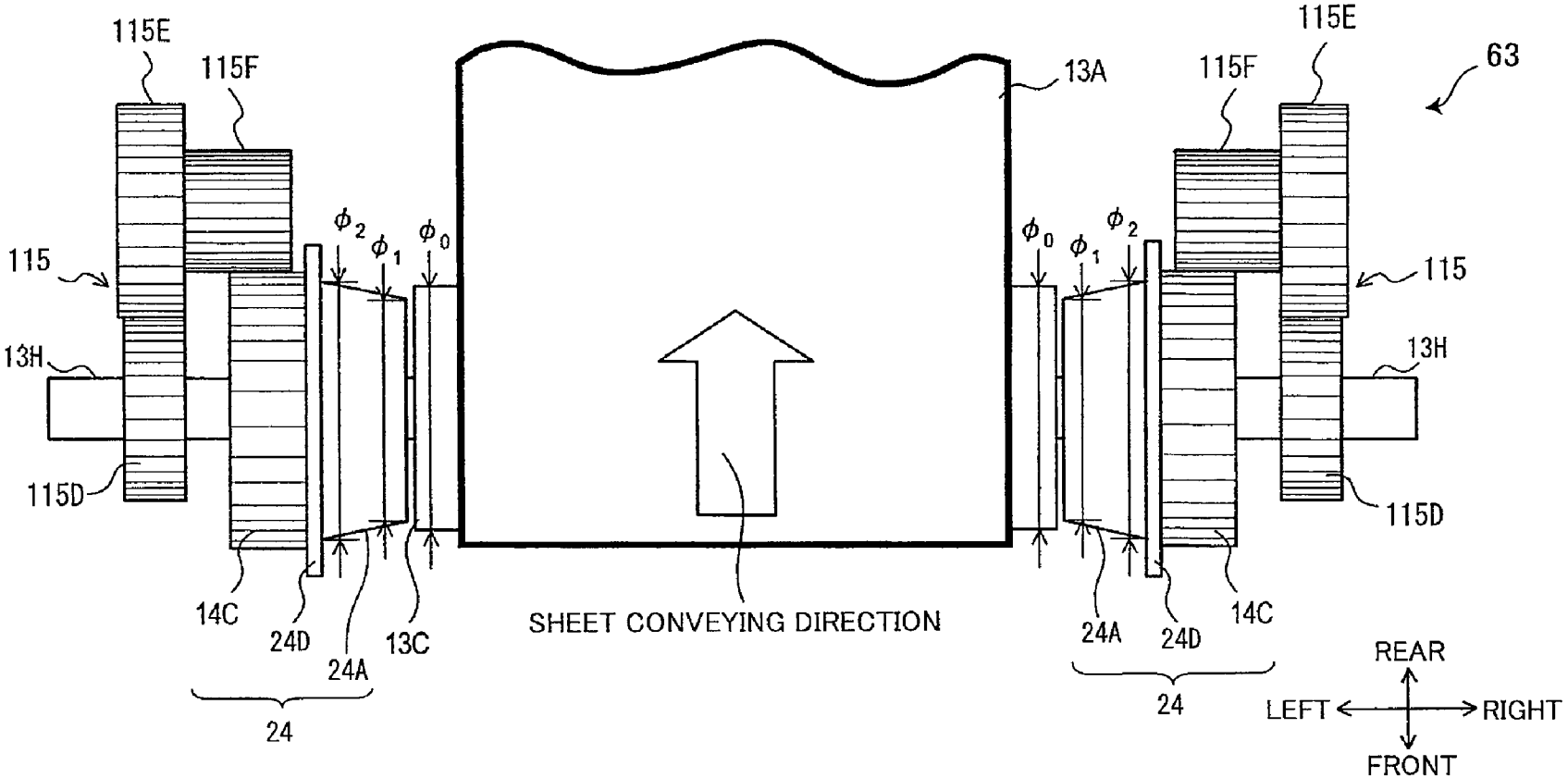
FIG. 13 is a view illustrating features of a belt unit according to a sixth embodiment of the present invention.

Next, a belt unit 63 according to a sixth embodiment of the present invention will be described next while referring to FIG. 13. As shown in FIG. 13, in contrast to the friction surface 14A of tension collar 14 having a constant diameter in the fifth embodiment, the belt unit 63 includes each tension collar 24 having a friction surface 24A formed in a tapered-shape. In other words, the tension collar 24 is formed in a circular truncated cone shape. Specifically, a diameter $\phi 1$ of one end of the friction surface 24A is set to be smaller than a diameter $\phi 2$ of other end of the friction surface 24A. The diameter $\phi 1$ is a diameter of the friction surface 24A closer to the follow roller 13C, while the diameter $\phi 2$ is a diameter of the friction surface 24A closer to the gear section 14C. A diameter $\phi 0$ of the follow roller 13C is arranged to be greater than the diameter $\phi 1$, but smaller than the diameter $\phi 2$. Note that the compression coil spring 13F is omitted in FIG. 13.

In addition, each tension collar 24 is provided with a flange 24D at a position between the friction surface 24A and the gear section 14C so as to protrude in a radial direction of the tension collar 24 along the whole circumference of the flange 24D.

With the above-described configuration, when the transfer belt 13A gets skewed and moves toward either tension collar 24 side from the follow roller 13C, the transfer belt 13A is allowed to move smoothly onto the friction surface 24A, thereby preventing the transfer belt 13A from being damaged.

Further, the friction surface 24A is formed in a tapered-shape with the diameter $\phi 1$ being smaller than the diameter $\phi 2$. Therefore, as the skew becomes greater, the transfer belt 13A can receive the greater braking force and the greater tension. Accordingly, the skew in the transfer belt 13A can be efficiently suppressed.

Further, instead of the above-described configuration of the friction surface 24A, the diameter $\phi 1$ may be adjusted to be equal to the diameter $\phi 0$, or alternatively, the diameter $\phi 2$ may be designed to be equal to the diameter $\phi 0$.

Further, although the speed reduction mechanism 115 of the sixth embodiment shown in FIG. 13 is provided with the gear mechanism the same as that of the fifth embodiment, the speed reduction mechanism 115 may employ a planetary gear mechanism as in the fourth embodiment.

Figure 14:
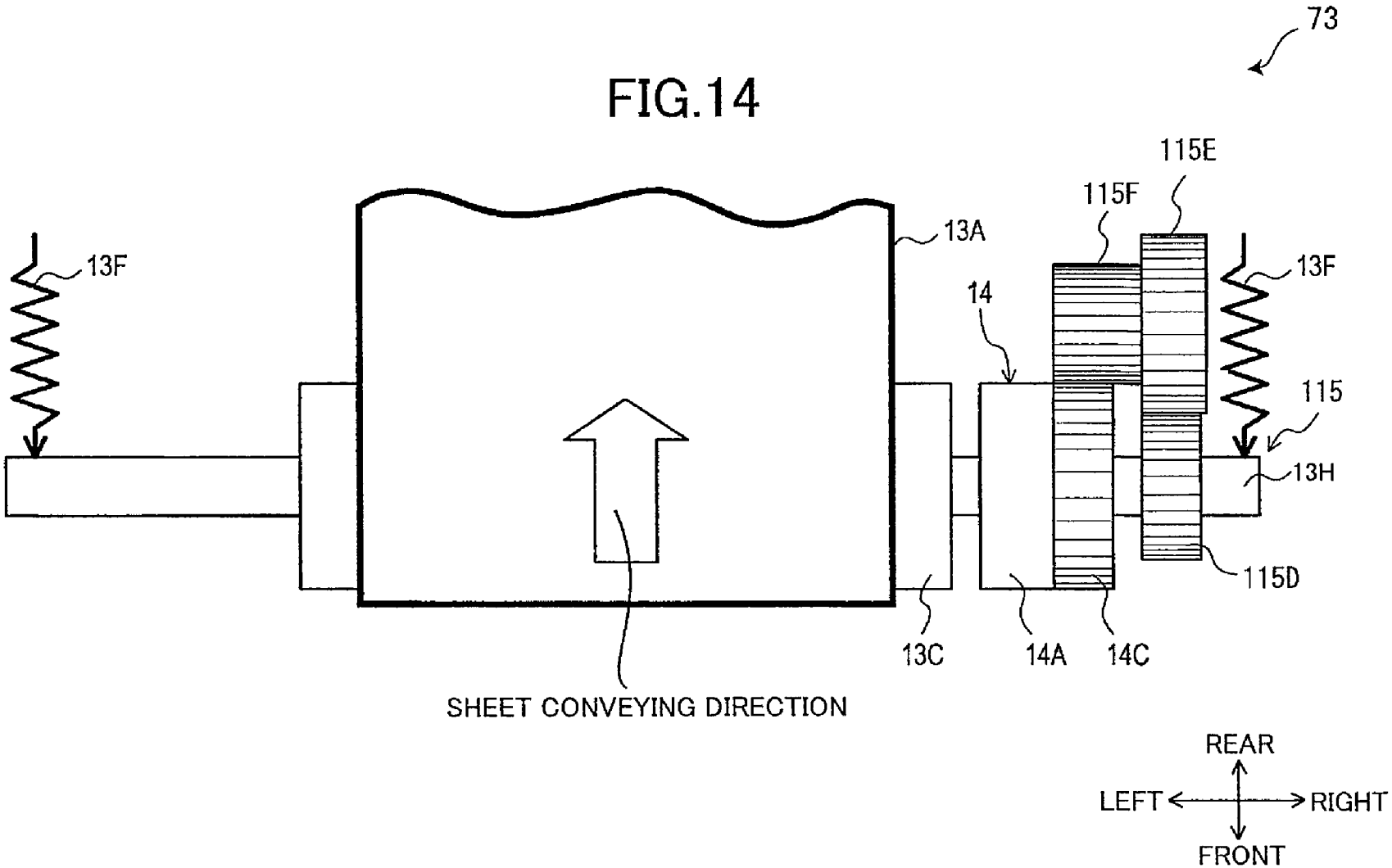
FIG. 14 is a view illustrating features of a belt unit according to a seventh embodiment of the present invention.

Next, a belt unit 73 according to a seventh embodiment will be described with reference to FIG. 14. The belt unit 73 is different from the belt unit 53 according to the fifth embodiment in that the tension collar 14 is provided only on one of the axial ends of the follow roller 13C, as shown in FIG. 14. Under this structure, preferably the transfer belt 13A is designed to skew in a direction toward one axial end of the follow roller 13C (the end on which the tension collar 14 is provided) from the other axial end (the end on which the tension collar 14 is not provided).

Instead of the speed reduction mechanism 115 provided with the gear mechanism the same as that of the fifth embodiment, the belt unit 73 may employ the speed reduction mechanism 15 that is a planetary gear mechanism as in the fourth embodiment.

As a further variation, the speed reduction mechanism 15, 115 according to the fourth to seventh embodiments employs gears, but friction force of a rubber roller or a belt may also be utilized in transmitting rotational force to the speed reduction mechanism 15, 115.

Further, the speed reduction mechanism 15 according to the fourth embodiment employs the planetary gear train in which the sun gear 15A is used as input, while the traveling of the planetary gears 15B serves as output. However, the present invention is not confined to the above configuration.

That is, the speed reduction mechanism 15 according to the fourth embodiment shown in FIGS. 9 and 10 is a so-called planetary-type planetary gear mechanism (i.e., the outer gear 15C is held stationary). Therefore, the reduction ratio cannot be greater than 0.5. However, if the speed reduction mechanism 15 employs a so-called solar-type planetary gear mechanism (i.e., the sun gear 15A is fixed), the outer gear 15C serves as input side, and the tension collar 14 serving as a carrier of the planetary gears 15B serves as output side. In this case, the reduction ratio can be made greater than 0.5. Accordingly, the solar-type planetary gear mechanism is effective in a belt unit in which the circumferential speed of the tension collar 14 need not to be set too small relative to that of the follow roller 13C, or in a belt unit in which the circumferential speed of the tension collar 14 should not be set too small.

Figure 12:
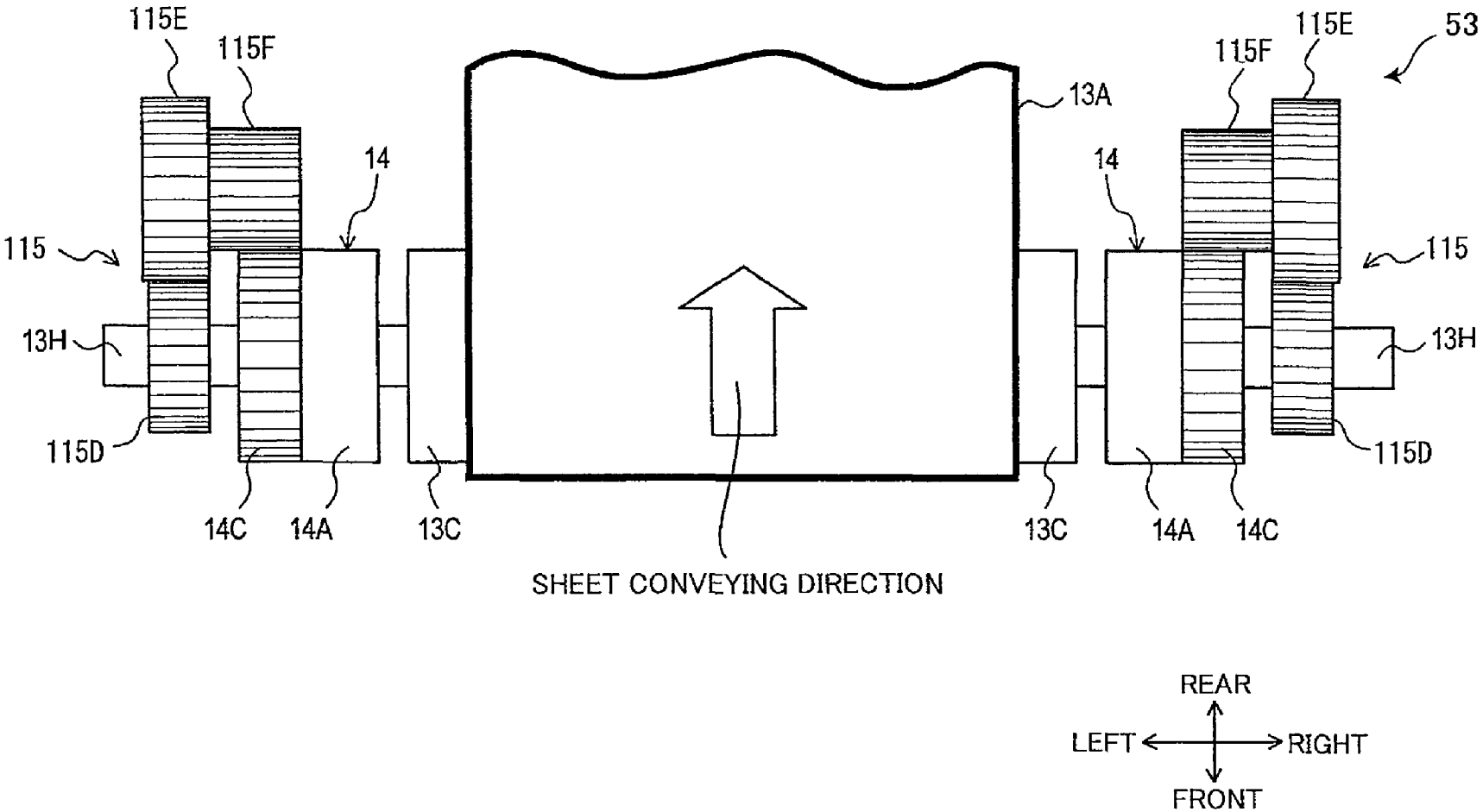
FIG. 12 is a diagram illustrating features of a belt unit according to a fifth embodiment of the present invention.

In the fifth through seventh embodiments shown in FIGS. 12 through 14, a desired reduction ratio can be realized easily by selecting the number of teeth in each of the first gear 115D, the second gear 115E, the third gear 115F and the gear section 14C of the tension collar 14 as appropriate.

Further, the follow roller 13C does not necessarily serve as a tension roller in the fourth to seventh embodiments. The belt unit 43, 53, 63, or 73 may employ a tension roller separately as in the third embodiment.

Further, the tension collar 14 is made to rotate in response to the rotational force transmitted from the follow roller 13C in the fourth to seventh embodiments. As a variation, driving force may be supplied to the tension collar 14 from the drive roller 13B, or from a driving source that supplies driving force to the drive roller 13B.

In the first to seventh embodiments, the belt unit according to the present invention is applied to a direct tandem type image forming device. However, the belt unit according to the present invention may also be applicable to a belt unit mountable in a device other than an image forming device, or to an image forming device of a type other than a direct tandem type.

What is claimed is:

1. A belt unit comprising:

an endless belt;

a drive roller configured to drive the endless belt to move circularly;

a follow roller configured to rotate about an axis thereof following circular movement of the endless belt, the axis extending in an axial direction, the endless belt being wound around the drive roller and the follow roller;

a braking member disposed on at least one side of the follow roller and configured to rotate about the axis and to apply a rotational friction force to the endless belt when the endless belt skews and frictionally contacts the braking member; and at least one gear, wherein one of the at least one gear is configured to engage the breaking member.

2. The belt unit according to claim 1, further comprising a tension-maintaining unit configured to maintain a constant tension imparted on the endless belt.

3. The belt unit according to claim 2, wherein the follow roller includes a rotational shaft;

wherein the tension maintaining unit includes a pressing member that presses the rotational shaft in a first direction perpendicular to the axial direction, wherein the rotational shaft is supported to be movable in the first direction and in a second direction opposite the first direction, wherein the rotational shaft is moved away from the drive roller when the rotational shaft is moved in the first direction, wherein the rotational shaft is moved toward the drive roller when the rotational shaft is moved in the second direction.

4. The belt unit according to claim 1, wherein the braking member is configured to rotate following the circular movement of the endless belt when the endless belt skews and frictionally contacts the braking member, and wherein the breaking member is configured to apply a rotational friction force to the endless belt greater than a rotational friction force applied by the follow roller to the endless belt.

5. The belt unit according to claim 1, wherein the braking member is configured to rotate slower than the follow roller.

6. The belt unit according to claim 1, wherein the braking member is formed in a circular cylindrical shape having a diameter that is substantially equal to a diameter of the follow roller.

7. The belt unit according to claim 1, wherein the braking member includes a part formed in a circular truncated cone shape having a first end and a second end, the second end being disposed closer to the follow roller than the first end, the first end having a diameter greater than a diameter of the follow roller, the second end having a diameter smaller than the diameter of the follow roller.

8. The belt unit according to claim 1, further comprising another braking member of a same construction as the braking member;

wherein the breaking member is disposed on one side of the follow roller and the other braking member is disposed on another side of the follow roller.

9. The belt unit according to claim 1, wherein the braking member has a friction coefficient greater than a frictional coefficient of the follow roller.

10. The belt unit according to claim 1, wherein the at least one gear is driven by the braking member.

11. The belt unit according to claim 1, wherein the at least one gear includes a damper gear configured to impart rotational resistance to the braking member.

12. A belt unit comprising:

an endless belt;

a drive roller configured to drive the endless belt to move circularly;

a follow roller configured to rotate about a rotational shaft thereof following circular movement of the endless belt, the rotational shaft extending in an axial direction and having two axial ends, the endless belt being wound around the drive roller and the follow roller; and a braking member disposed on one of the two axial ends, wherein the braking member is rotatable about the rotational shaft and applies a rotational friction force to the endless belt when the endless belt is in frictional contact with the braking member; and a rotational force applying member rotatable about an axis, wherein a rotational force required to rotate the braking member is greater than a rotational force required to rotate the follow roller, and wherein the rotational force applying member is coupled to the braking member, and is configured to apply a rotational force to the braking member while the rotational force applying member is rotating.

13. The belt unit according to claim 12, wherein a reaction force generated when the rotational force applying member is in contact with the braking member causes the rotational shaft to move in a first direction perpendicular to the axial direction, and further causes tension generated on the endless belt to increase.

14. The belt unit according to claim 13, wherein the rotational shaft is supported to be movable in the first direction and a second direction opposite the first direction.

15. A belt unit comprising:

an endless belt;

a drive roller configured to drive the endless belt to move circularly;

a follow roller including a rotational shaft, the follow roller being configured to rotate about the rotational shaft by following circular movement of the endless belt, the rotational shaft extending in an axial direction, the endless belt being wound around the drive roller and the follow roller;

a braking member configured to apply a rotational friction force to the endless belt when the endless belt skews and frictionally contacts the braking member; and a drive mechanism configured to rotate the braking member not via the endless belt such that a circumferential speed of the braking member is smaller than a circumferential speed of the follow roller.

16. The belt unit according to claim 15, wherein the drive mechanism is configured to receive a rotational force from the follow roller.

17. The belt unit according to claim 15, wherein the drive mechanism includes a sun gear configured to receive a rotational force from the follow roller and a planetary gear engaging the sun gear.

18. The belt unit according to claim 17, wherein the braking member includes a shaft to which the planetary gear is attached.

19. The belt unit according to claim 18, wherein the drive mechanism includes an outer gear configured to engage the planetary gear, and wherein the outer gear does not rotate relative to the rotational shaft.

* * * * *